US009435498B1

(12) United States Patent
Anderson

(10) Patent No.: US 9,435,498 B1
(45) Date of Patent: Sep. 6, 2016

(54) LINE VOLTAGE LIGHT BAR

(71) Applicant: Kenneth E. Anderson, Kearney, NE (US)

(72) Inventor: Kenneth E. Anderson, Kearney, NE (US)

( * ) Notice: Subject to any disclaimer, the term of this patent is extended or adjusted under 35 U.S.C. 154(b) by 5 days.

(21) Appl. No.: 14/568,426

(22) Filed: Dec. 12, 2014

(51) Int. Cl.

| | |
|---|---|
| ***F21V 33/00*** | (2006.01) |
| ***F21S 4/00*** | (2016.01) |
| ***F21V 21/26*** | (2006.01) |
| *F21Y 103/00* | (2016.01) |

(52) U.S. Cl.
CPC ..... *F21S 4/008* (2013.01); *F21V 21/26* (2013.01); *F21V 33/0012* (2013.01); *F21Y 2103/003* (2013.01)

(58) Field of Classification Search
CPC .... F21V 33/00; F21V 33/0012; F21V 21/26; F21W 2131/301; F21S 8/00; F21S 8/03; F21S 8/033; F21S 8/036; F21S 8/043; F21S 4/008; A47F 11/10; A47B 97/00
USPC ..... 362/133, 285, 287
See application file for complete search history.

(56) References Cited

U.S. PATENT DOCUMENTS

| | | | | |
|---|---|---|---|---|
| 4,454,569 | A * | 6/1984 | Maguire | F21S 2/005 362/127 |
| 5,984,486 | A * | 11/1999 | Munz et al. | F21V 21/02 362/127 |
| 7,331,696 | B2 * | 2/2008 | Rupert et al. | A47B 97/00 362/133 |
| 2010/0058690 | A1 * | 3/2010 | Rowohlt | E04F 19/0436 52/287.1 |
| 2013/0235569 | A1 * | 9/2013 | McGowan et al. | F21V 33/0048 362/223 |

* cited by examiner

*Primary Examiner* — Y M. Lee
(74) *Attorney, Agent, or Firm* — Dennis L. Thomte; Thomte Patent Law Office LLC

(57) ABSTRACT

A light bar configured to be mounted beneath a cabinet, above a cabinet, within a cabinet or any other placement requiring illumination. The light bar includes a first support member which is fixed onto a supporting surface. A second support member is pivotally secured to the first support member so as to be selectively movable between open and closed positions with respect to the first support member. An LED light strip is mounted in the second support member so as to direct light rays through a lens mounted on the lower support member. The electrical components of the light bar are readily accessible when the second support member is in its open position.

6 Claims, 5 Drawing Sheets

LINE VOLTAGE LIGHT BAR

BACKGROUND OF THE INVENTION

1. Field of the Invention

This invention relates to a line voltage light bar which may be positioned at the underside of a cabinet adjacent the wall which supports the cabinet. The light bar may also be positioned on top of the cabinet, at the side of the cabinet, or inside the cabinet. More particularly, this invention relates to a line voltage light bar which includes a fixed upper support member and a lower support member which is pivotally secured to the upper support member and which is selectively movable between open and closed positions with respect to the upper support member. An LED light strip is positioned in the lower support member at the outer side thereof.

2. Description of the Related Art

Elongated light bars have been positioned below cabinets for many years to illuminate the areas beneath the cabinet. The light bars are usually affixed to the underside of the cabinets or to a vertically disposed backsplash or wall which extends downwardly from the inner end of the cabinet.

Although the prior art light bars do function very well to illuminate the areas below the cabinets, the repair or replacement of the parts thereof is quite difficult since the interior components thereof are not readily accessible.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A line voltage light bar is disclosed which may be positioned at the underside of a cabinet adjacent the wall which supports the cabinet. The light bar may also be positioned on top of the cabinet, at the side of the cabinet, inside the cabinet, or at any location wherein lighting is required. The light bar of this invention will be described as if it were positioned beneath a cabinet adjacent the supporting wall thereof.

The light bar of this invention includes an elongated and horizontally disposed upper wall having an inner end, an outer end, a first end, a second end, an upper surface and a lower surface. The upper wall of the upper support member has a first elongated connector element, having first and second ends, positioned therebelow which is spaced inwardly from the outer end thereof. The upper support member also includes an elongated and vertically disposed inner wall having an upper end, a lower end, a first end, a second end, an inner surface and an outer surface. The inner wall of the upper support member has an elongated and horizontally disposed second connector element at its lower end. A first vertically disposed end wall extends downwardly from the first end of the top wall of the upper support member and extends outwardly from the first end of the inner wall of the upper support member towards the outer end of the top wall of the upper support member. The upper support member has a vertically disposed second end wall which extends downwardly from the second end of the top wall of the upper support member and which extends outwardly towards the outer end of the top wall of the upper support member.

The light bar also includes an elongated lower support member which includes an elongated and generally horizontally disposed first wall member having a first end, a second end, an inner end and an outer end. The lower support member also includes an elongated second wall member, having a first end, a second end, an inner end and an outer end with the second wall member extending upwardly and outwardly from the outer end of the first wall member of the lower support member. The lower support member also includes an elongated and upstanding third wall member having a first end, a second end, a lower end, an upper end, an inner side and an outer side with the third wall member extending outwardly from the outer end of the second wall member thereof. The lower support member also includes an elongated and generally horizontally disposed fourth wall member having a first end, a second end, an inner end, an outer end, an upper surface and a lower surface which extends outwardly from the upper end of the third wall member. The lower support member further includes an elongated and downwardly extending fifth wall member having a first end, a second end, a lower end, an upper end, an inner side and an outer side with the fifth wall member extending downwardly from the outer end of the fourth wall member. The lower support member also includes an elongated sixth wall member, having a first end, a second end, an inner end and an outer end with the sixth wall member extending outwardly from the lower end of the fifth wall member.

The inner end of the first wall member of the lower support member has a third connector element formed thereon which is configured to be selectively secured to the first connector element to yieldably maintain the lower support member in its closed position. An elongated LED light strip is secured to the lower surface of the fourth wall member and an elongated lens is selectively removably secured to the third and fifth wall members below the LED light strip and which extends therebetween.

If any of the components of the light bar require repair or replacement, the lower support member is pivotally moved to its open position with respect to the upper support member so that the interior components of the light bar are readily accessible.

It is therefore a principal object of the invention to provide a light bar which includes a fixed first support member having a second support member pivotally secured thereto whereby the second support member may be moved between open and closed positions with respect to the first support member so that the first support member so that the interior of the light bar is readily accessible for repair or replacement of the components therein.

A further object of the invention is to provide a light bar of the type described which may be positioned beneath a cabinet, on top of a cabinet, at one side of a cabinet or the interior of a cabinet.

A further object of the invention is to provide a light bar of the type described which can be used at any location where lighting is required.

A further object of the invention is to provide a light bar of the type described which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
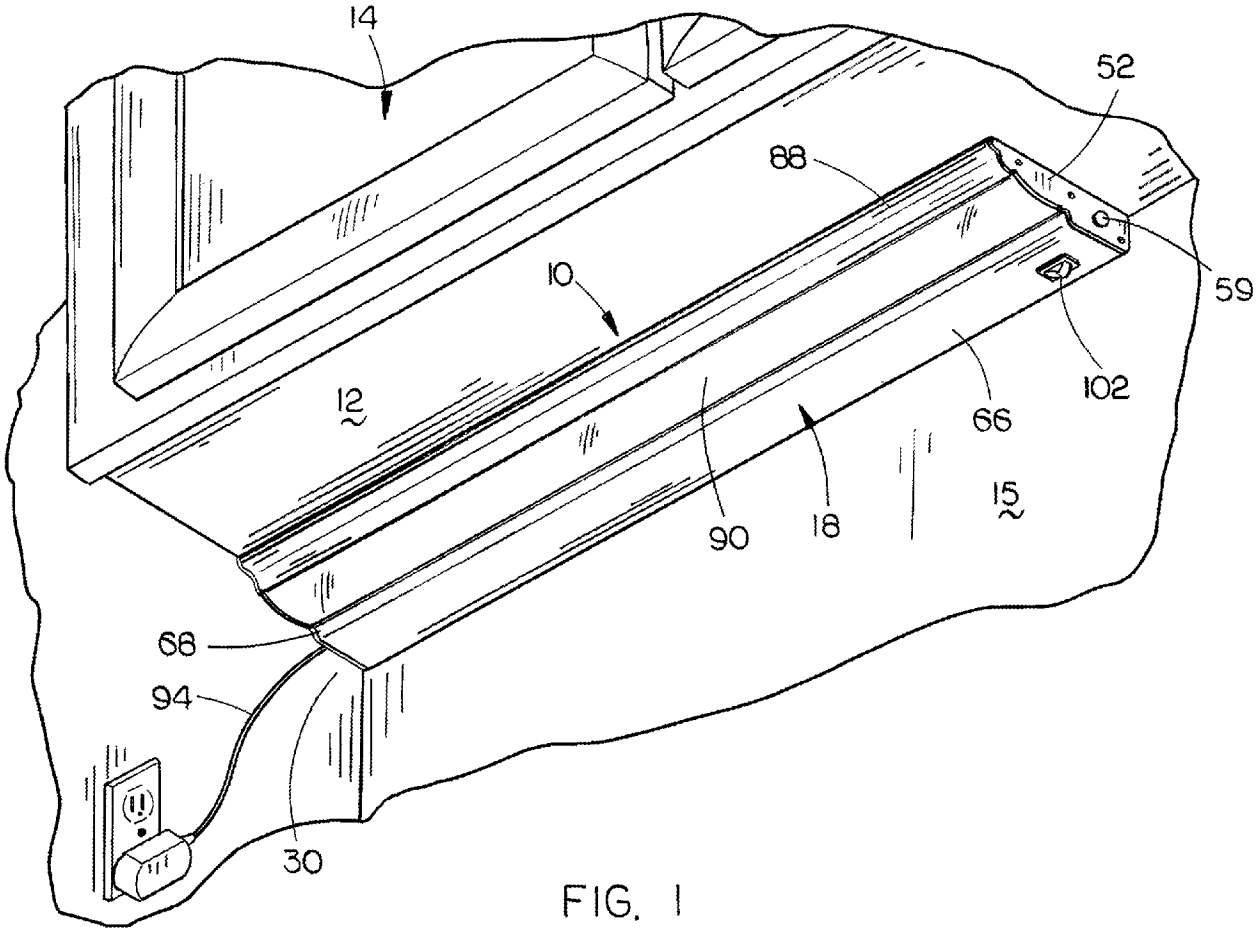
FIG. 1 is a perspective view illustrating the light bar of this invention mounted at the underside of a cabinet.
Figure 2:
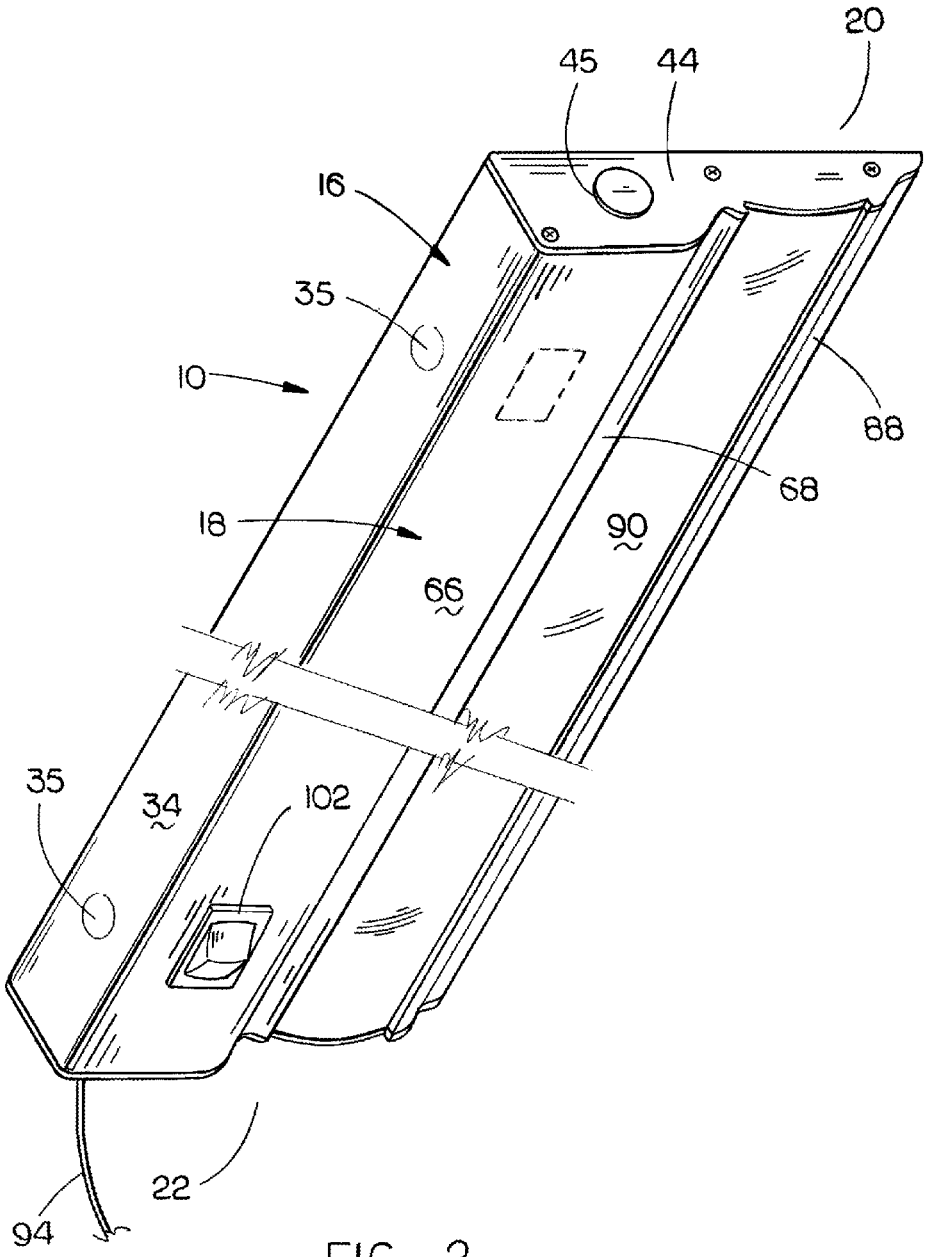
FIG. 2 is a partial lower perspective view of the light bar of this invention.
Figure 3:
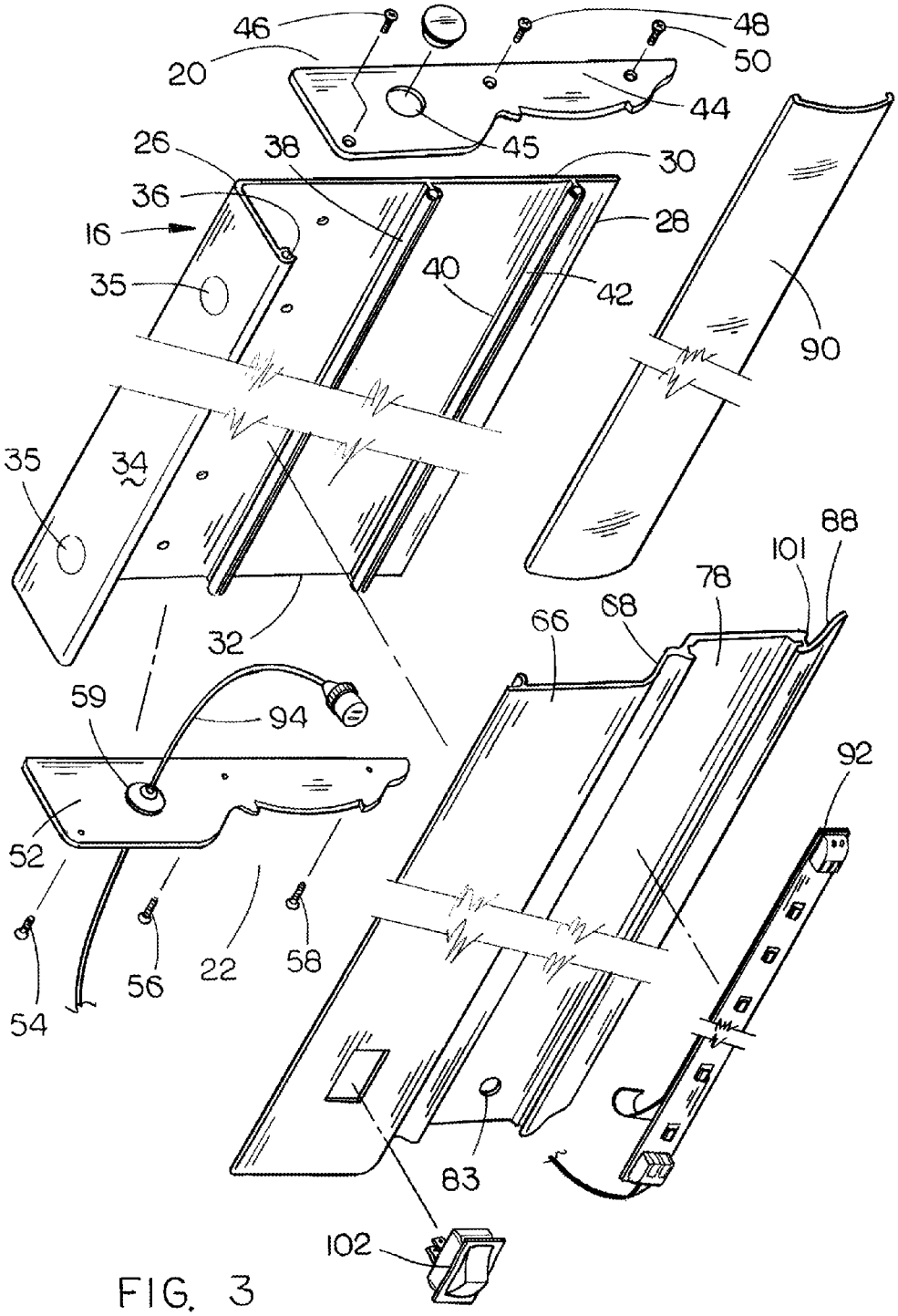
FIG. 3 is an exploded lower perspective view of the light bar of this invention.
Figure 4:
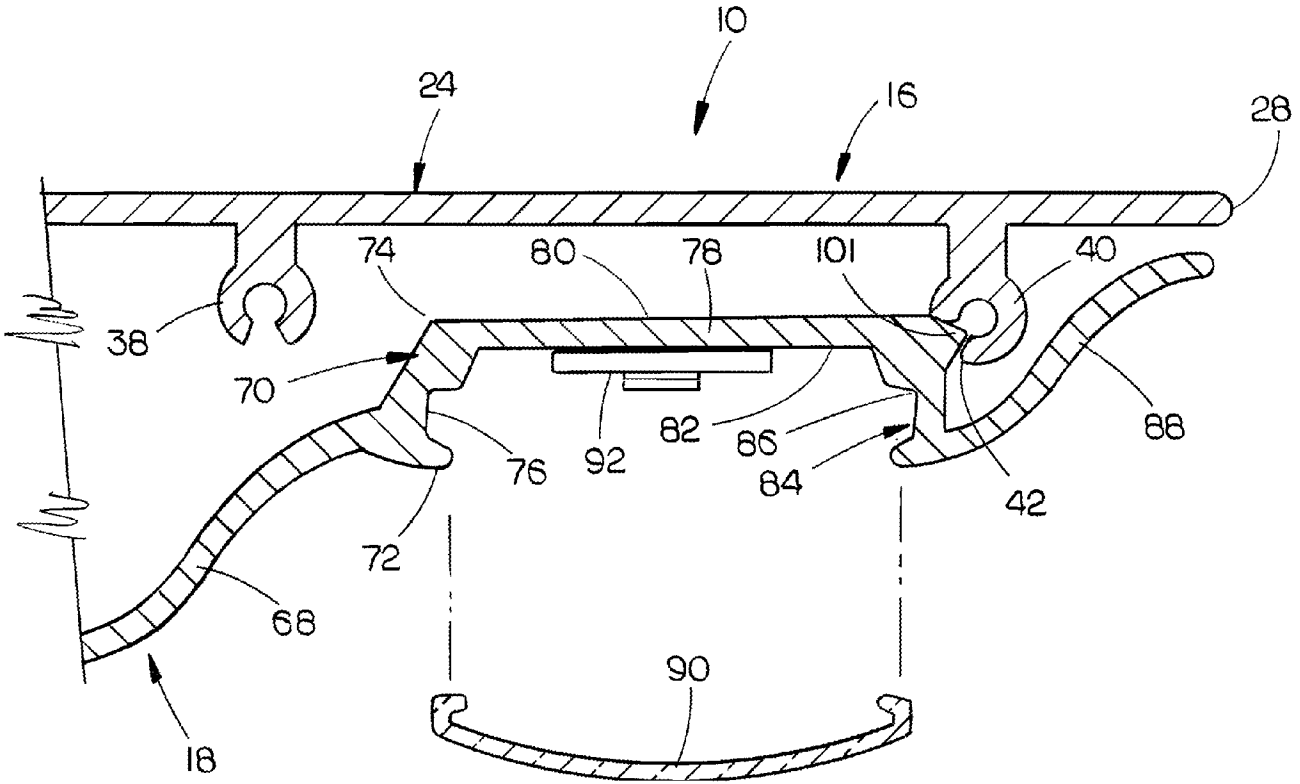
FIG. 4 is a partial sectional view of the light bar of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The line voltage light bar of this invention is referred to by the reference numeral 10. Light bar 10 is designed to be secured to the underside 12 of a cabinet 14 or to the wall 15 supporting the cabinet 14. The light bar 10 may also be positioned on top of the cabinet 14, at the side of the cabinet 14, or in the interior of the cabinet 14. The light bar 10 may also be positioned on any structure where lighting is desired. Light bar 10 includes an upper support member 16 and a lower support member 18 selectively pivotally secured thereto. The upper support member 16 and the lower support member 18 are preferably comprised of extruded aluminum which is powder coated. Support members 16 and 18 could also be comprised of anodized aluminum. Upper support member 16 will be described as having a first end 20 and a second end 22. The length of the light bar 10 will vary depending upon the width of the cabinet or the structure to which it is attached. Upper support member 16 includes a horizontally disposed upper wall 24 having an inner end 26, an outer end 28, a first end 30 and a second end 32.

Upper support member 16 also includes a rear wall 34 which extends downwardly from the inner end 26 of upper wall 24. Preferably, rear wall 34 has one or more knock-outs 35 formed therein. The lower end of rear wall 34 is provided with an elongated arcuate connector element 36 which extends between the ends 30 and 32 of upper support member 16. The numeral 38 refers to an elongated tubular boss which extends between the ends 30 and 32 of upper support member 16. Upper support member 16 also includes an elongated, tubular connector element 40 having an elongated slot 42 formed therein which extends between the ends thereof.

End cap 44 is secured to the first end 30 of upper support member 16 by screws 46, 48, and 50 extending through end cap 44 into the ends of connector element 36, boss 38 and connector element 40 respectively. End cap 52 is secured to the second end 32 of support member 16 by screws 54, 56 and 58 extending through end cap 52 into the outer ends of connector element 36, boss 38 and connector element 40 respectively.

End cap 52 may have an opening 59 formed therein to permit electrical wires to extend therethrough. Further, the rear wall 34 could have an opening formed therein which communicates with an opening formed in wall 15 to permit electrical wires to extend therethrough. Further, end cap 44 may also have an opening 45 formed therein to permit electrical wires to extend therethrough.

The upper support member 16 is secured to the underside 12 of the cabinet 14 by a plurality of screws 41 which extend through upper wall 24 into cabinet 14.

Lower support member 18 will be described as having an inner end 60 and an outer end 62. The inner end 60 of lower support member 18 has an elongated semi-circular connector element or lip 64 formed thereon which is configured to selectively pivotally engage the connector element 36 as will be described in detail hereinafter. Lower support member 18 includes a bottom wall portion 66, which extends outwardly from the inner end 60 thereof. The numeral 68 refers to a wall portion which extends upwardly and outwardly from the outer end of wall portion 66. The upper outer end of wall portion 68 terminates in an upstanding and elongated wall 70 having a lower end 72 and an upper end 74. The outer surface of wall 70 has an elongated groove or slot 76 formed therein. An elongated and horizontally disposed wall 78 extends outwardly from the upper end 74 of wall 70 and has an upper surface 80 and a lower surface 82. Wall 78 has an opening 83 formed therein to permit electrical wires to extend therethrough.

The numeral 84 refers to an elongated and downwardly extending wall portion which extends downwardly from the outer end of wall portion 78. The inner surface of wall portion 84 has an elongated groove or slot 86 formed therein. An elongated, arcuate wall portion 88 extends outwardly and upwardly from the lower end of wall portion 84. An elongated lens 90 has its inner end received in slot 76 of wall portion 70 and has its outer end received in slot 86 of wall portion 84. An elongated LED light strip 92 is secured to the lower surface 82 of wall portion 78 by any suitable means such as an adhesive or double-faced tape. The LED light strip 92 may be hardwired or have an electrical cord extending therefrom to an electrical outlet. The electrical wire 94 from the light strip 92 may extend through the opening 59 formed in end cap 52, or through an opening 45 formed in end cap 44 or through an opening formed in wall portion 34.

Figure 5:
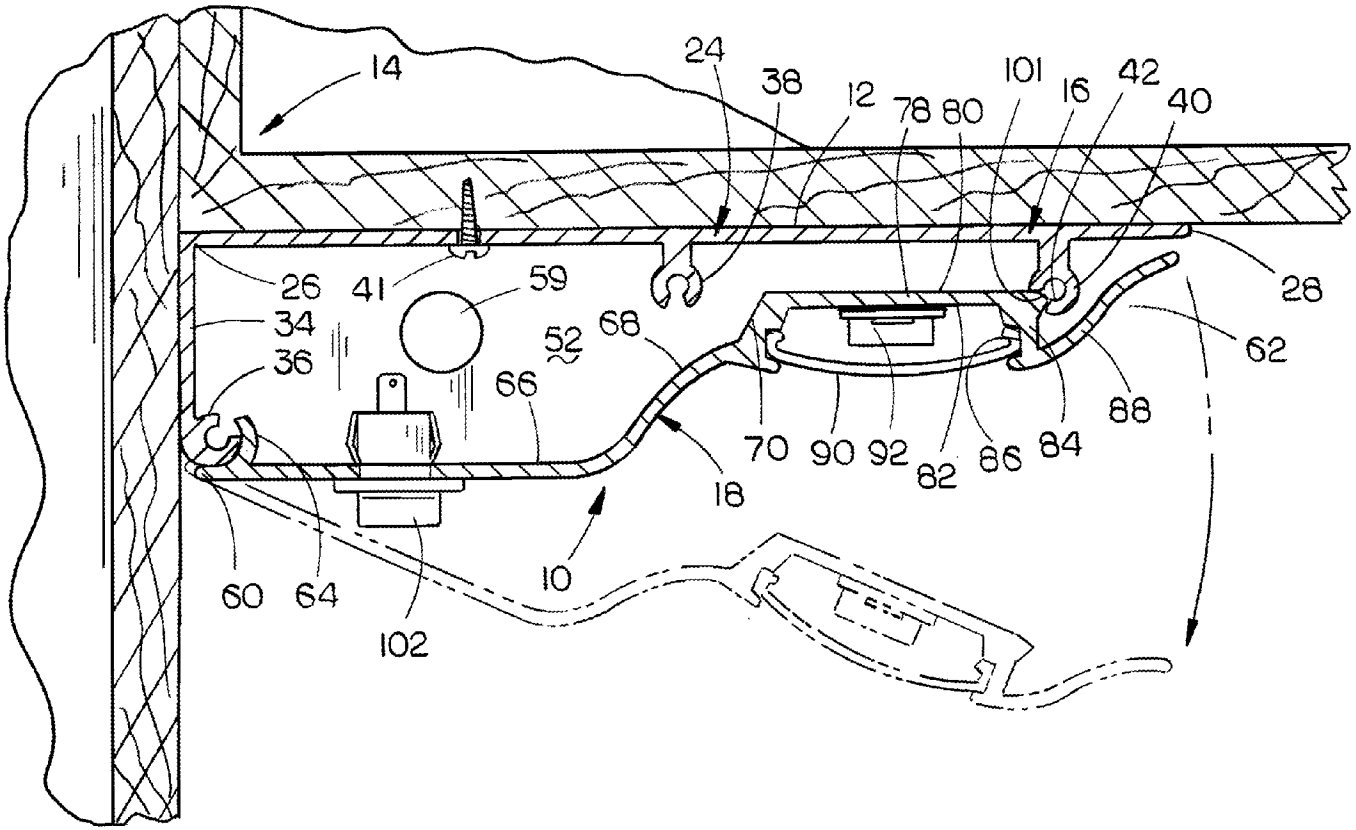
FIG. 5 is a sectional view of the light bar of this invention mounted on the underside of a cabinet with the broken lines illustrating the lower support member of the light bar in an open position.

In use, the lower support member 18 will be pivoted to the closed position shown in FIG. 5. When lower support member 18 is closed, the upper outer end 101 of wall portion 84 is received in the slot 42 formed in connector element 40 to yieldably lock the lower support member 18 in its closed position. With the lower support member 18 in its closed position of FIG. 5, the activation of the light strip 92 by the switch 102 mounted in wall portion 66, the LEDs in the light strip 92 will direct light downwardly through the lens 90 to illuminate the area therebelow.

If the light strip 92 should fail and need repair or replacement, a person simply pulls down on the outer end of wall portion 88 to disengage the upper outer end 101 of wall portion 84 to enable the lower support member 18 to be moved to its open position as illustrated by the broken lines of FIG. 5 with the lower support member 18 in its open position, the lens 90 may be removed from the lower support member 18 thereby permitting a person to easily gain access to the light strip 92, the electrical wires within the light bar 10, and the switch 102 to repair or replace the same.

As stated above, the light bar 10 may be mounted beneath the cabinet 14, above the cabinet 14, inside the cabinet, or any other place where lighting is required. Thus, it can be seen that the light bar of this invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A light bar for positioning beneath a cabinet, comprising:

an elongated upper support member including:

a. an elongated and horizontally disposed upper wall having an inner end, an outer end, a first end, a second end, an upper surface and a lower surface;

b. said upper wall of said upper support member having a first elongated connector element, having first and second ends, positioned therebelow which is spaced inwardly from said outer end thereof;

c. said upper support member also including an elongated and vertically disposed inner wall having an upper end, a lower end, a first end, a second end, an inner surface and an outer surface;

d. said inner wall of said upper support member having an elongated and horizontally disposed second connector element at its said lower end;

e. a vertically disposed first end wall which extends downwardly from said first end of said upper wall of said upper support member and which extends outwardly from said first end of said inner wall of said upper support member towards said outer end of said top wall of said upper support member;

f. said upper support member having a vertically disposed second end wall which extends downwardly from said second end of said upper wall of said upper support member and which extends outwardly from said second end of said inner wall of said upper support member towards said outer end of said upper wall of said upper support member;

an elongated lower support member including:

a. an elongated and generally horizontally disposed first wall member having a first end, a second end, an inner end and an outer end;

b. an elongated second wall member, having a first end, a second end, an inner end and an outer end with said second wall member extending upwardly and outwardly from said outer end of said first wall member;

c. an elongated and upstanding third wall member having a first end, a second end, a lower end, an upper end, an inner side and an outer side with said third wall member extending upwardly from said outer end of said second wall member;

d. an elongated and generally horizontally disposed fourth wall member having a first end, a second end, an inner end, an outer end, an upper surface and a lower surface which extends outwardly from said upper end of said third wall member;

e. an elongated and downwardly extending fifth wall member having a first end, a second end, a lower end, an upper end, an inner side and an outer side with said fifth wall member extending downwardly from said outer end of said fourth wall member; and f. an elongated sixth wall member having a first end, a second end, an inner end and an outer end with said sixth wall member extending outwardly from said lower end of said fifth wall member;

said inner end of said first wall member of said lower support member having a third connector element therein which is configured to pivotally engage said second connector element whereby said lower support member is selectively pivotally movable between closed and open positions with respect to said upper support member;

said upper end of said fifth wall member having a fourth connector element formed thereon which is configured to be selectively secured to said first connector element to yieldably maintain said lower support member in said closed position;

an elongated LED light strip secured to said lower surface of said fourth wall member; and an elongated lens selectively removably secured to said third and fifth wall members below said LED light strip and which extends therebetween.

2. The light bar of claim 1 wherein said outer side of said third wall member has an elongated and horizontally disposed slot formed therein and wherein said inner side of said fifth wall member has an elongated and horizontally disposed slot formed therein and wherein said lens has an inner end which is received in said slot in said third wall member and has an outer end which is received in said slot in said fifth wall member.

3. The light bar of claim 1 wherein said first and second end walls of said upper support member are removably secured to said upper wall and said inner wall of said upper support member.

4. A light bar, comprising:

an elongated upper support member including:

a. an elongated and horizontally disposed upper wall having an inner end, an outer end, a first end, a second end, an upper surface and a lower surface;

b. said upper wall of said upper support member having a first elongated connector element, having first and second ends, positioned therebelow which is spaced inwardly from said outer end thereof;

c. said upper support member also including an elongated and vertically disposed inner wall having an upper end, a lower end, a first end, a second end, an inner surface and an outer surface;

d. said inner wall of said upper support member having an elongated and horizontally disposed second connector element at its said lower end;

e. a vertically disposed first end wall which extends downwardly from said first end of said upper wall of said upper support member and which extends outwardly from said first end of said inner wall of said upper support member towards said outer end of said upper wall of said upper support member;

f. said upper support member having a vertically disposed second end wall which extends downwardly from said second end of said upper wall of said upper support member and which extends outwardly from said second end of said inner wall of said upper support member towards said outer end of said upper wall of said upper support member;

an elongated lower support member including:

a. an elongated and generally horizontally disposed first wall member having a first end, a second end, an inner end and an outer end;

b. an elongated second wall member, having a first end, a second end, an inner end and an outer end with said second wall member extending upwardly and outwardly from said outer end of said first wall member;

c. an elongated and upstanding third wall member having a first end, a second end, a lower end, an upper end, an inner side and an outer side with said third wall member extending upwardly from said outer end of said second wall member;

d. an elongated and generally horizontally disposed fourth wall member having a first end, a second end, an inner end, an outer end, an upper surface and a lower surface which extends outwardly from said upper end of said third wall member;

e. an elongated and downwardly extending fifth wall member having a first end, a second end, a lower end, an upper end, an inner side and an outer side with said fifth wall member extending downwardly from said outer end of said fourth wall member; and f. an elongated sixth wall member having a first end, a second end, an inner end and an outer end with said sixth wall member extending outwardly from said lower end of said fifth wall member;

said inner end of said first wall member of said lower support member having a third connector element therein which is configured to pivotally engage said second connector element whereby said lower support member is selectively pivotally movable between closed and open positions with respect to said upper support member;

said upper end of said fifth wall member having a fourth connector element formed thereon which is configured to be selectively secured to said first connector element to yieldably maintain said lower support member in said closed position;

an elongated LED light strip secured to said lower surface of said fourth wall member; and an elongated lens which is selectively removably secured to said third and fifth wall members below said LED light strip and which extends therebetween.

5. The light bar of claim 4 wherein said outer side of said third wall member has an elongated and horizontally disposed slot formed therein and wherein said inner side of said fifth wall member has an elongated and horizontally disposed slot formed therein and wherein said lens has an inner end which is received in said slot in said third wall member and has an outer end which is received in said slot in said fifth wall member.

6. The light bar of claim 4 wherein said first and second end walls of said upper support member are removably secured to said top wall and said inner wall of said upper support member.

* * * * *